US011668130B2

(12) United States Patent
Gunn et al.

(10) Patent No.: US 11,668,130 B2
(45) **Date of Patent: *Jun. 6, 2023**

(54) REFRIGERATOR WITH PUSH-TO-OPEN DOOR OPENER

(71) Applicant: Haier US Appliance Solutions, Inc., Wilmington, DE (US)

(72) Inventors: Tanner Davis Gunn, Louisville, KY (US); Michael Goodman Schroeder, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 106 days.

This patent is subject to a terminal disclaimer.

(21) Appl. No.: 17/115,141

(22) Filed: Dec. 8, 2020

(65) Prior Publication Data

US 2022/0178194 A1 Jun. 9, 2022

(51) Int. Cl.

| | |
|---|---|
| ***E05F 15/00*** | (2015.01) |
| ***E05F 15/73*** | (2015.01) |
| ***E05F 15/622*** | (2015.01) |
| ***F25D 23/02*** | (2006.01) |

(52) U.S. Cl.

CPC ..... *E05F 15/73* (2015.01); *E05F 15/622* (2015.01); *F25D 23/028* (2013.01); *E05Y 2201/434* (2013.01); *E05Y 2201/474* (2013.01); *E05Y 2201/70* (2013.01); *E05Y 2201/702* (2013.01); *E05Y 2201/71* (2013.01); *E05Y 2400/856* (2013.01); *E05Y 2900/31* (2013.01)

(58) Field of Classification Search

CPC .. E05F 15/73; E05F 15/622; E05Y 2201/434; E05Y 2201/474; E05Y 2201/70; E05Y 2201/702; E05Y 2201/71; E05Y 2400/856; E05Y 2900/31

USPC ..... 49/31, 279, 280, 287

See application file for complete search history.

(56) References Cited

U.S. PATENT DOCUMENTS

| | | | | |
|---|---|---|---|---|
| 9,410,735 | B2 * | 8/2016 | Maas | F25D 29/00 |
| 9,534,829 | B2 * | 1/2017 | Held | F25D 23/028 |
| 10,364,599 | B2 * | 7/2019 | Lee | E05F 15/616 |
| 10,648,218 | B1 | 5/2020 | Schroeder et al. | |
| 11,073,327 | B2 * | 7/2021 | Kim | F25D 23/087 |
| 11,143,451 | B2 * | 10/2021 | Caglin | E05F 5/02 |
| 2011/0048060 | A1 * | 3/2011 | Kim | E05B 17/0029 62/449 |
| 2013/0154461 | A1 * | 6/2013 | Bohle | E05F 15/614 312/319.6 |

(Continued)

FOREIGN PATENT DOCUMENTS

JP 2001/174146 A 6/2001

*Primary Examiner* — Chi Q Nguyen

(74) *Attorney, Agent, or Firm* — Dority & Manning, P.A.

(57) ABSTRACT

A refrigerator appliance includes a cabinet defining a food storage chamber. A door is positioned on the cabinet and is movable between a closed position and an open position. A door opener includes a casing, a gear box, a sliding nut movable relative to the gear box, and a finger extending through the gear box. The finger is movable with the sliding nut. The door opener also includes a sensor. The finger extends outside of the casing to contact an inner surface of the door when the door is in the closed position and the door opener is in a zero position. The sensor is configured to detect movement of the door opener from the zero position.

16 Claims, 10 Drawing Sheets

(56) References Cited

U.S. PATENT DOCUMENTS

| | | | | |
|---|---|---|---|---|
| 2014/0306596 | A1* | 10/2014 | Linke | E05F 15/611 312/405 |
| 2015/0338156 | A1* | 11/2015 | Held | E05D 7/00 312/405 |
| 2018/0187470 | A1* | 7/2018 | Song | F25D 23/087 |
| 2018/0347892 | A1 | 12/2018 | Kim et al. | |
| 2020/0157860 | A1 | 5/2020 | Lee et al. | |
| 2021/0254884 | A1* | 8/2021 | Hong | F25D 23/028 |

* cited by examiner

REFRIGERATOR WITH PUSH-TO-OPEN DOOR OPENER

FIELD OF THE INVENTION

The subject matter of the present disclosure relates generally to appliances having a cabinet and a door. For example, such appliances may include refrigerator appliances.

BACKGROUND OF THE INVENTION

Refrigerator appliances generally include a cabinet that defines one or more chilled chambers for receipt of food items for storage. One or more insulated, sealing doors are provided for selectively enclosing the chilled food storage chamber(s). Generally, the door(s) are movable between a closed position and an open position for accessing food items stored therein by pulling on the door(s), such as by pulling on a handle on the door.

In some instances, for example, when a user's hands are full of groceries to load into the refrigerator or are covered in raw food ingredients from cooking, etc., a user may prefer to open the door without having to grasp the door, or a part of the door such as the handle, in the user's hand. In particular, a user may prefer to nudge or push on the door to open the door.

Accordingly, a refrigerator having an improved means for opening a door thereof would be useful. In particular, a refrigerator appliance having a means for opening a door by pushing on the door would be desirable.

BRIEF DESCRIPTION OF THE INVENTION

Aspects and advantages of the invention will be set forth in part in the following description, or may be apparent from the description, or may be learned through practice of the invention.

In a first exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber extends between a front portion and a back portion along the transverse direction. The front portion of the food storage chamber defines an opening for receipt of food items. A door is positioned at the front portion of the food storage chamber and is movable between a closed position and an open position. The door thus selectively sealingly encloses the food storage chamber in the closed position and provides access to the food storage chamber in the open position. A door opener is positioned in the cabinet. The door opener includes a casing, a gear box, a sliding nut movable relative to the gear box, and a finger extending through the gear box towards the door. The finger is movable with the sliding nut. The door opener also includes a sensor. The finger is positioned in contact with an inner surface of the door when the door is in the closed position and the door opener is in a zero position. The sensor is configured to detect movement of the door opener from the zero position of the door opener.

In a second exemplary embodiment, a door opener for a refrigerator appliance is provided. The door opener defines a vertical direction, a lateral direction, and a transverse direction. The vertical, lateral, and transverse directions are mutually perpendicular. The refrigerator appliance includes a cabinet defining a food storage chamber and a door mounted on the cabinet. The door is movable between a closed position and an open position to selectively sealingly enclose the food storage chamber in the closed position and provide access to the food storage chamber in the open position. The door opener includes a casing, a gear box, a sliding nut movable relative to the gear box, and a finger extending through the gear box. The finger is movable with the sliding nut. The door opener also includes a sensor. The finger extends outside of the casing to contact an inner surface of the door when the door is in the closed position and the door opener is in a zero position. The sensor is configured to detect movement of the door opener from the zero position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
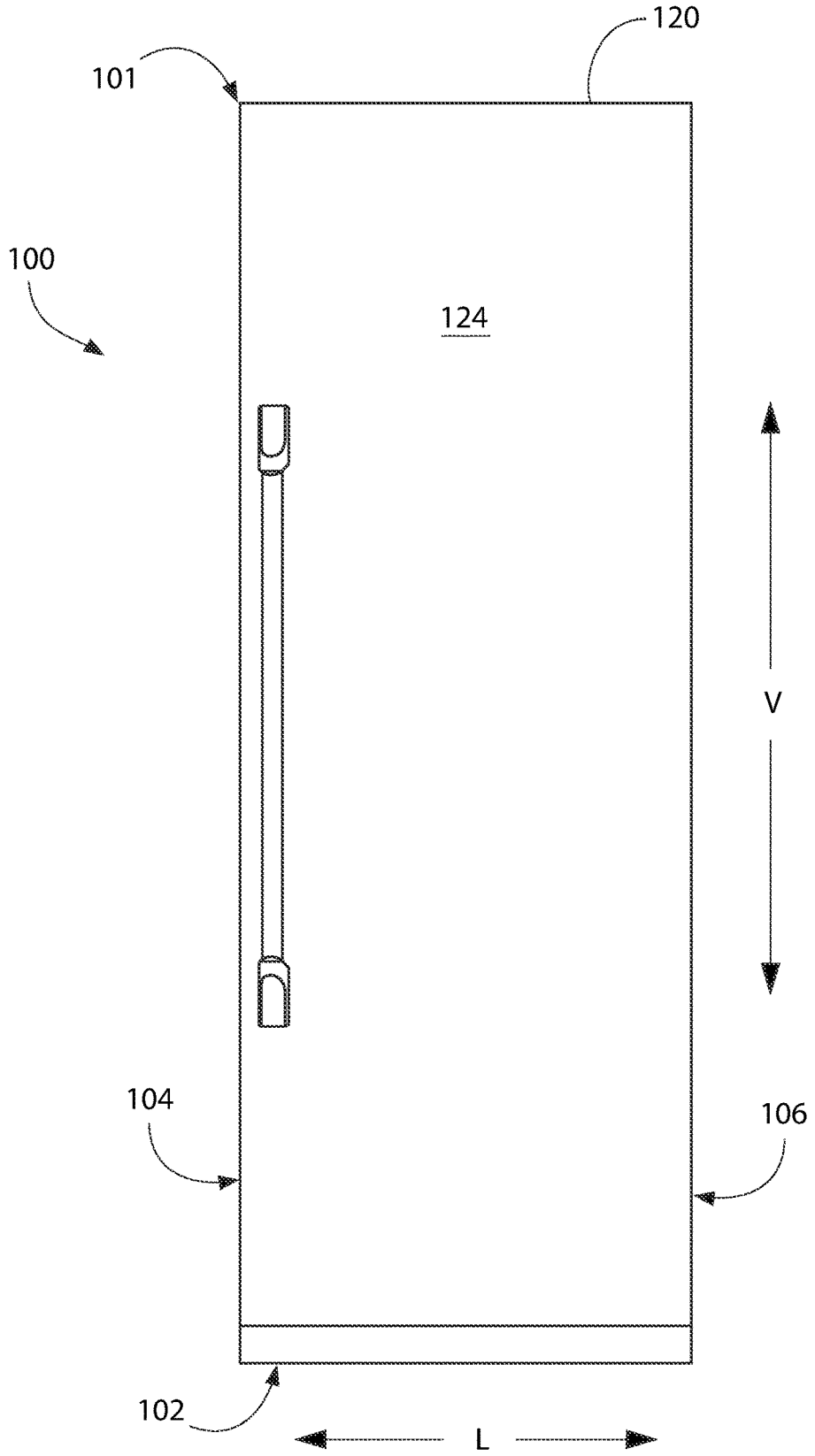
FIG. 1 provides a front elevation view of a refrigerator appliance according to an exemplary embodiment of the present subject matter with a door of the refrigerator appliance shown in the closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the door(s) and reaches into the food storage chamber(s) to access items therein.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
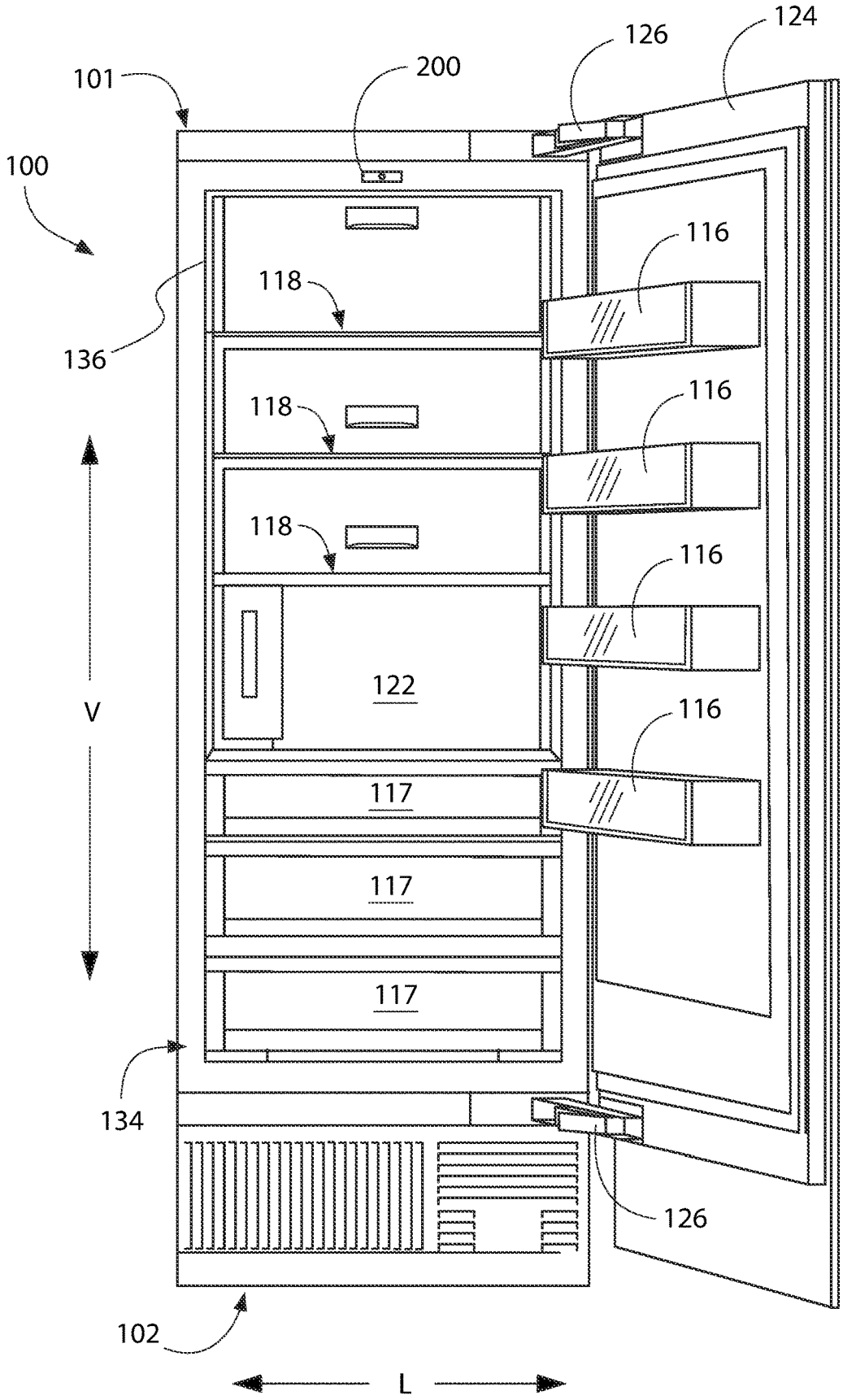
FIG. 2 provides a front elevation view of the exemplary refrigerator appliance of FIG. 1 with the door shown in an open position.
Figure 3:
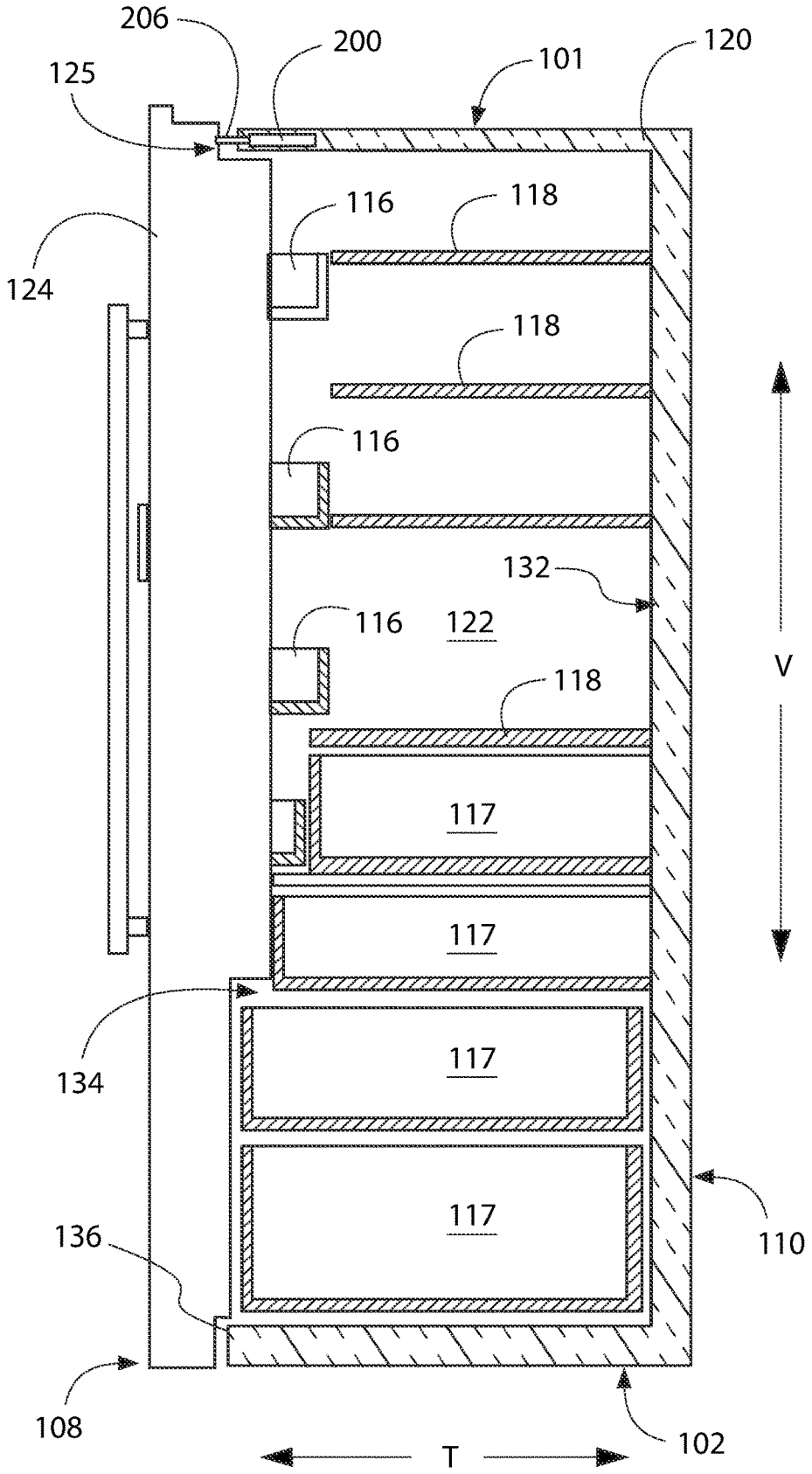
FIG. 3 provides a cross-section view of the exemplary refrigerator appliance of FIG. 1.

As illustrated in FIGS. 1 through 3, an exemplary refrigerator appliance 100 has an insulated housing or cabinet 120 that defines a food storage chamber 122. A door 124 is provided to selectively sealingly enclose the food storage chamber 122 when in a closed position (FIG. 1) and provide access to the food storage chamber 122 when in an open position (FIG. 2). The door 124 is rotatably mounted to the cabinet 120, such as by one or more hinges 126 (FIG. 2), to rotate between the open position and the closed position.

Refrigerator appliance 100 defines a vertical direction V, a lateral direction L, and a transverse direction T (FIG. 3), each mutually perpendicular to one another. As may be seen in FIGS. 1 through 3, the cabinet or housing 120 extends between a top 101 and a bottom 102 along the vertical direction V, between a left side 104 and a right side 106 along the lateral direction L, and between a front 108 (FIG. 3) and a rear 110 (FIG. 3) along the transverse direction T. As may be seen in FIGS. 2 and 3, the food storage chamber 122 extends between a front portion 134 and a back portion 132 along the transverse direction T. The front portion 134 of the food storage chamber 122 defines an opening 136 for receipt of food items. The food storage chamber 122 is a chilled chamber 122 for receipt of food items for storage. As used herein, the chamber may be "chilled" in that the chamber is operable at temperatures below room temperature, e.g., less than about seventy-five degrees Fahrenheit (75° F.). One of ordinary skill in the art will recognize that the food storage chamber 122 may be chilled by a sealed refrigeration system, such that the food storage chamber 122 may be operable at or about the temperatures described herein by providing chilled air from the sealed system. The structure and function of such sealed systems are understood by those of ordinary skill in the art and are not described in further detail herein for the sake of brevity and clarity.

Refrigerator door 124 is rotatably mounted, e.g., hinged, to an edge of cabinet 120 for selectively accessing the fresh food storage chamber 122 within the cabinet 120. Refrigerator door 124 may be mounted to the cabinet 120 at or near the front portion 134 of the food storage chamber 122 such that the door 124 moves, e.g., rotates via hinges 126, between the closed position (FIG. 1) and the open position (FIG. 2). In the closed position of FIG. 1, the door 124 sealingly encloses the food storage chamber 122. Additionally, one or more gaskets and other sealing devices, which are not shown but will be understood by one of ordinary skill in the art, may be provided to promote sealing between the door 124 and the cabinet 120. In the open position of FIG. 2, the door 124 permits access to the fresh food storage chamber 122.

As shown for example in FIGS. 2 and 3, various storage components may be mounted within the food storage chamber 122 to facilitate storage of food items therein as will be understood by those skilled in the art. In particular, the storage components include bins 116, drawers 117, and shelves 118 that are mounted within fresh food chamber 122. Bins 116, drawers 117, and shelves 118 are configured for receipt of food items (e.g., beverages and/or solid food items) and may assist with organizing such food items.

As depicted, cabinet 120 defines a single chilled chamber 122 for receipt of food items for storage. In the present example, the single chilled chamber 122 is a fresh food chamber 122. In some embodiments, the chilled chamber may be a freezer chamber and/or the refrigerator appliance 100 may include one or more additional chilled chambers for receipt of various food items and storage of such items at various temperatures as desired. For example, the refrigerator appliance 100 may include one or more chilled chambers configured for deep freeze (e.g., at about 0° F. or less) storage, or configured for chilling, e.g., produce or wine, at relatively warmer temperatures such as about 60° F. or more, as well as any suitable temperatures between the stated examples. In various exemplary embodiments, the chilled chamber 122 may be selectively operable at any number of various temperatures and/or temperature ranges as desired or required per application, and/or the refrigerator appliance 100 may include one or more additional chambers selectively operable at any suitable food storage temperature.

The illustrated exemplary refrigerator appliance 100 is generally referred to as a single-door or single-purpose refrigerator, sometimes also referred to as a column refrigerator. It is recognized, however, that the benefits of the present disclosure apply to other types and styles of refrigerators such as, for example, a bottom mount refrigerator, a top mount refrigerator, a side-by-side style refrigerator, or a freezer appliance. Consequently, the description set forth herein is for illustrative purposes only and is not intended to be limiting in any aspect to a particular refrigerator chamber configuration. Additionally, door openers as described herein may be useful in other types of appliances such as microwave oven appliances, clothes washer/dryer appliances, etc., and/or other contexts wherever the disclosed features may be desired.

As may be seen in FIGS. 2 and 3, the refrigerator appliance 100 may include a door opener 200. The door opener 200 may be positioned in the cabinet 120. For example, the door opener 200 may be positioned in the cabinet 120 proximate the front 108 of the cabinet 120 and the opening 136 of the food storage chamber 122. In the illustrated exemplary embodiment, the door opener 200 is positioned proximate the top 101 of the cabinet 120 along the vertical direction V and is generally centered along the lateral direction L. That is, the example door opener 200, as best seen in FIG. 2, is positioned at or about a lateral midpoint of the cabinet 120 and/or the opening 136 of the food storage chamber 122. In other embodiments, the door opener 200 may be positioned at other locations within the cabinet 120, such as near the bottom 102 along the vertical direction V. In some embodiments, centering the door opener 200 along the lateral direction L may advantageously provide flexibility in mounting the door 124. For example, the illustrated refrigerator appliance 100 includes the door 124 mounted on the right side 106. In other embodiments, the door 124, e.g., the hinges 126, may be mounted to the cabinet 120 at or near the left side 104. In embodiments where the door opener 200 is centered along the lateral direction L, the door opener 200 will apply generally the same opening force to the door 124 when the door 124 is mounted to either left side 104 or right side 106, e.g., the moment arm or leverage applied to the door 124 as it rotates about the hinges 126 will be generally the same.

Figure 4:
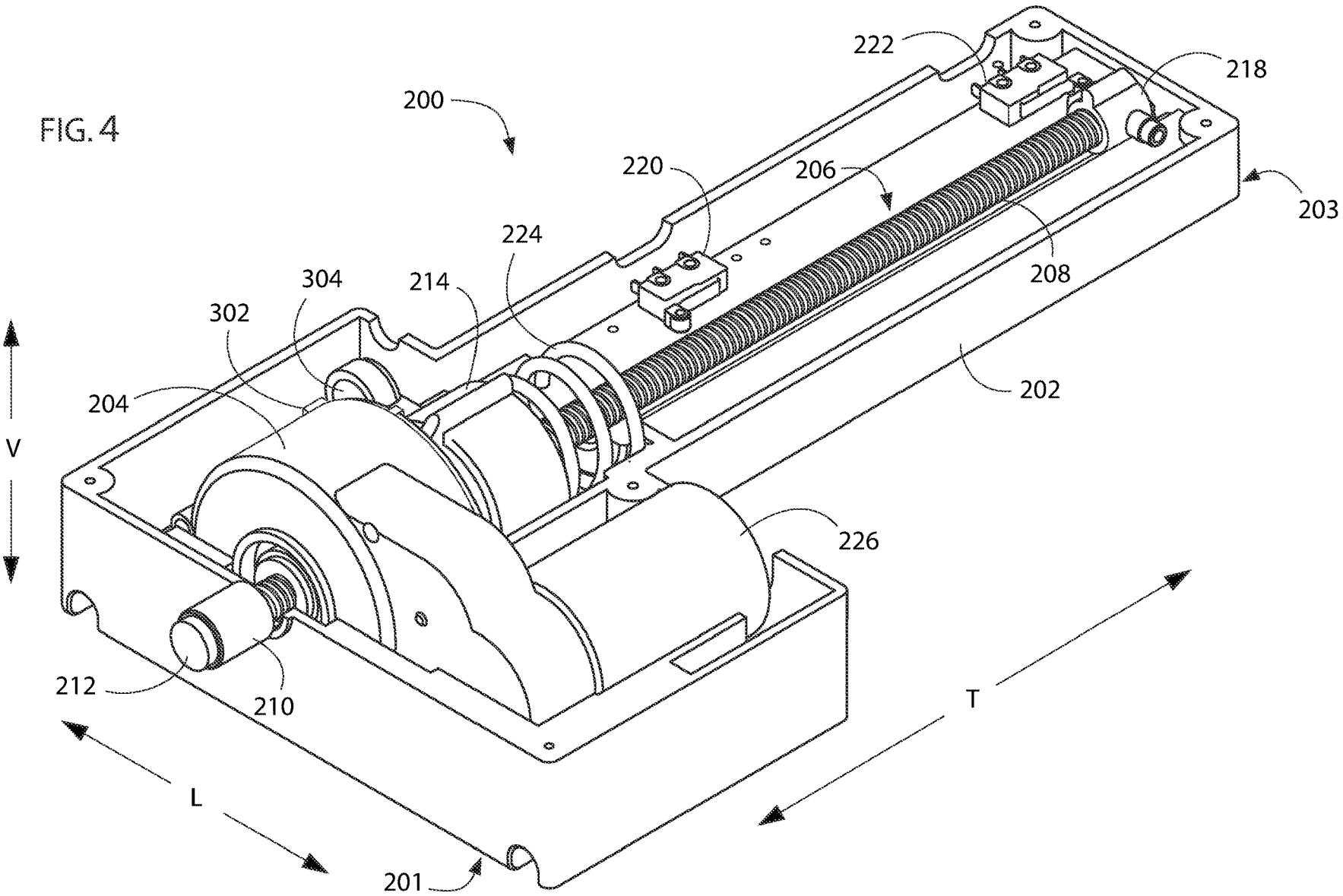
FIG. 4 provides a perspective view of an exemplary door opener which may be incorporated into appliances such as the refrigerator appliance of FIG. 1.

Turning now to FIG. 4, the door opener 200 defines a vertical direction V, a lateral direction L, and a transverse direction T. The vertical direction V, the lateral direction L, and the transverse direction T are mutually perpendicular. The door opener 200 may include a casing 202 extending from a back portion 203 to a front portion 201 along the transverse direction T. The door opener 200 is generally oriented and installed in the refrigerator appliance 100 such that the corresponding directions are generally aligned, e.g., are within ten degrees of each other. For example, the door opener 200 may be positioned, e.g., mounted, within the cabinet 120 such that the vertical direction V defined by the door opener 200 is generally the same as the vertical direction V defined by the refrigerator appliance 100, the lateral direction L defined by the door opener 200 is generally the same as the lateral direction L defined by the refrigerator appliance 100, and the transverse direction T defined by the door opener 200 is generally the same as the transverse direction T defined by the refrigerator appliance 100. Additionally, the front portion 201 of the casing 202 is generally proximate or aligned with the front 108 of the cabinet 120 along the transverse direction T, while the back portion 203 of the casing 202 is correspondingly closer to the back 110 of the cabinet 120 than to the front 108 of the cabinet 120.

The casing 202 of the door opener 200 may be fixedly mounted to the cabinet 120, e.g., via mechanical fasteners. The casing 202 may be fixedly mounted to the cabinet 120 in that the casing 202 is not movable relative to the cabinet 120 during the ordinary and intended operation of the refrigerator appliance 100 (including the door opener 200 thereof). The door opener 200 also includes a gear box 204 positioned within the casing 202 and fixed in place relative to the casing 202. The door opener 200 may include a finger 206 which includes a front portion or rod portion 210 and a threaded back portion or power screw portion 208. In some embodiments, the finger 206 may include a tip 212 which engages the inner surface 125 of the door 124. The finger 206, e.g., rod portion 210 thereof, may extend through the gear box 204 and the casing 202 towards the door 124 of the refrigerator appliance 100, e.g., as may be seen in FIG. 3. In alternate embodiments, the entire finger 206 may be threaded, or the front portion 210 may be threaded while the back portion 208 is not. As depicted in FIG. 3, the door opener 200 is in a zero position. FIG. 3 illustrates the zero position of the door opener 200 relative to the refrigerator appliance 100. Additionally, the door opener 200 may be movable, e.g., forward along the transverse direction T, from the zero position to an extended position, where the finger 206 extends from the casing 202 sufficiently to urge the door 124 away from the cabinet 120, e.g., away from the closed position illustrated in FIG. 3 and towards the open position illustrated in FIG. 2. As will be understood by those of skill in the art, the hinges 126 may be configured to move the door 124 completely to the open position shown in FIG. 2 given sufficient momentum towards the open position, and sufficient momentum may be imparted to the door 124 by the door opener 200 when the finger 206 is moved to the extended position. As seen in FIGS. 4, 5, 8, and 10 and described in more detail below, the door opener 200 may include a motor 226 in operative communication with the finger 206, e.g., the motor 226 may be configured to move the finger 206 between the zero position and the extended position.

The door opener 200 may also include a housing 214 and a sliding nut 216. The housing 214, sliding nut 216, and the finger 206 may be biased forward, e.g., towards front portion 201 of the casing 202 along the transverse direction T, within the casing 202 by a biasing element 224 in the zero position. The biasing element 224 may extend between the casing 202 and the housing 214, e.g., from the casing 202 to the housing 214 along the transverse direction T. In some embodiments, the biasing element 224 may be a coil spring 224 as illustrated. For example, as illustrated, the coil spring 224 may be mounted to the housing 214 and may extend circumferentially around an internal nipple 228 (FIG. 7) of the housing 214 at one end of the coil spring 224 and may bear against an internal flange 230 (FIG. 7) of the casing 202 at another, opposite, end of the coil spring 224. As noted above, the door 124 may be in the open position when the door opener 200 is in the extended position and the door 124 may be in the closed position when the door opener 200 is in the zero position. When the door 124 is in the closed position and the door opener 200 is in the zero position, the finger 206 will be in contact with an inner surface 125 of the door 124, as noted above and illustrated in FIG. 3. The door opener 200 may include a sensor 302 configured to detect movement of the door opener 200, such as the finger 206 thereof, from the zero position of the door opener 200. A push on the door 124 may result in relative movement of the finger 206 relative to the casing 202. The sliding nut 216 and the housing 214 may also move with the finger 206 from the zero position, e.g., backwards along the transverse direction T and against the biasing force of the biasing element 224, in response to the push on the door 124. For example, when the door 124 is in the closed position and the door opener 200 is in the zero position, the push on the door 124 may be transferred from the door 124 via the inner surface 125 of the door 124 to the finger 206, from the finger 206 to the sliding nut 216 due to threaded engagement between the finger 206 and the sliding nut 216, and from the sliding nut 216 to the housing 214 either by the sliding nut 216 pressing directly on the housing 214 or via bearing 240, causing the finger 206, sliding nut 216, and housing 214 to move backwards, e.g., inwards towards the interior of the cabinet 120 and/or the back portion 203 of the casing 202, along the transverse direction T. Such movement may be sensed or detected by the sensor 302, and the sensor 302 may be in operative communication with the motor 226. Thus, the sensor 302 may be configured to transmit a signal to the motor 226 when the sensor 302 detects movement of the housing 214 from the zero position of the door opener 200 towards the back portion 110 of the cabinet 120 and/or the back portion 203 of the casing 202 along the transverse direction T. In turn, the motor 226 may be configured to receive the signal from the sensor 302, to activate in response to the signal from the sensor 302, and to move the finger 206 towards the front portion 108 of the cabinet 120 and/or the front portion 201 of the casing 202 along the transverse direction T when the motor 226 is activated. In some embodiments, the door opener 200 may include a magnet 304 embedded in the housing 214. In such embodiments, the sensor 302 may be a Hall effect sensor 302 and may be configured to detect whether the housing 214 is in the zero position, including detecting movement of the housing 214 away from the zero position in response to a push on the door 124 as described above, based on the relative position of the magnet 304 with respect to the sensor 302. Additionally, in other embodiments the relative locations of the sensor 302 and the magnet 304 may be swapped, e.g., the sensor 302 may be embedded in the housing 214 and the magnet 304 may be fixed to the casing 202.

The biasing force of the coil spring 224 must be overcome for the housing 214 to move far enough relative to the casing 202 to trip the sensor 302 and activate the motor 226. Thus, the coil spring 224 may advantageously prevent or minimize inadvertent activation of the door opener 200. For example, when a user (or a pet, etc.) lightly brushes against the door 124, the door opener 200 may not be triggered due to the resistance against relative inward movement of the housing 214 by the biasing element, e.g., coil spring, 224. As another example, the biasing element, e.g., coil spring, 224 may protect the door opener 200 against door 124 slams. In some embodiments, e.g., as illustrated in FIGS. 4-7 and 10, the coil spring 224 may be positioned and configured for compression. For example, when the housing 214 moves relative to the casing 202 and towards the back portion 203 of the casing 202, the coil spring 224 will be compressed. In other embodiments, the coil spring 224 may be positioned and configured for tension. For example, the coil spring 224 may extend from the casing 202 to the housing 214 along the transverse direction T at the front portion 201 of the casing, such that the coil spring 224 will be stretched out and in tension when the housing 214 moves relative to the casing 202 and towards the back portion 203 of the casing 202.

In operation, when a user pushes on the door 124 while the door 124 is in the closed position and the door opener 200 is in the zero position, the force of the push is transferred to the housing 214, causing the housing 214 to move towards the back portion 110 of the cabinet 120 and/or towards the back portion 203 of the casing 202 along the transverse direction T relative to the casing 202. This relative movement is detected by the sensor 302, which transmits a signal to the motor 226, whereupon the motor 226 is activated and moves the finger 206 from the zero position to the extended position. When the door 124 is in the closed position and the finger 206 moves from the zero position to the extended position, such movement of the finger 206 overcomes the inertia of the door 124 and urges the door 124 towards the open position. In some embodiments, the hinges 126 may be configured such that once the door 124 begins to swing towards the open position, e.g., in response to the finger 206 of the door opener 200 pushing outward/forward along the transverse direction T against the inner surface 125, the momentum of the door 124 will carry the door 124 to the fully open position. In other embodiments, the door opener 200, e.g., the finger 206 thereof, may only travel far enough forward along the transverse direction T to nudge the door 124 to an intermediate, partially open, position, e.g., before reaching the tipping point at which the momentum of the door 124 will carry it to the fully open position. When the door opener 200 moves the door 124 to the partially open position, the door opener 200 may be configured to hold the door 124 in the partially open position for a predetermined time, e.g., a few seconds, so that the user may put an elbow, hand, foot, etc. in and completely open the door 124. "A few seconds" may include between about one second and about ten seconds, such as between about two seconds and about eight seconds, such as between about three seconds and about seven seconds, such as about five seconds. In further embodiments, the distance of travel from the zero position to the extended position may be variable, e.g., based on a user-selectable parameter, whereby the door opener 200 may be configured to selectively move the door 124 to one of a partially open position or the fully open position based on the user-selected distance of travel for the finger 206 between the zero position and the extended position. Thus, in various embodiments, after activating the door opener 200, e.g., the motor 226 thereof, the door opener 200 will be in the extended position and the door 124 will be in an open position, such as the fully open position or an intermediate position that is between the closed position and the fully open position, such as a partially open position.

From this point, the door opener 200 may further be configured to automatically retract, e.g., after a predetermined period of time (such as "a few seconds," as described above) the motor 226 may activate in a reverse direction to return the finger 206 to the zero position and, in some embodiments, the motor 226 may also retract the finger 206 beyond the zero position before returning to the zero position. The motor 226 may, for example, be configured to retract the finger 206 for a predetermined time and/or over a predetermined distance of travel backwards/inwards along the transverse direction T, e.g., until a back limit switch 222 is toggled, as described in more detail below, which results in the finger 206 retracting beyond the zero position. In such embodiments, when the door 124 moves to the fully closed position from an open position, the motor 226 may then activate again to move the finger 206 forwards along the transverse direction T from a retracted position beyond the zero position until the finger 206, e.g., the tip 212 thereof, contacts the inner surface 125 of the door 124. This contact will cause a shift in the housing 214 and the sensor 302 may be configured to detect the shift in the housing 214 when the tip 212 of the finger 206 contacts the inner surface 125 of the door 124. Thus, the sensor 302 may thereby detect that the door opener 200 has returned to the zero position based on, e.g., when and in response to, the finger 206 contacting the inner surface 125 of the door 124. The motor 226 may then be deactivated in response to the detected return to zero position from the sensor 302, e.g., by a signal from the sensor 302 indicating that the sensor 302 has detected that the door opener 200 has returned to the zero position.

Figure 5:
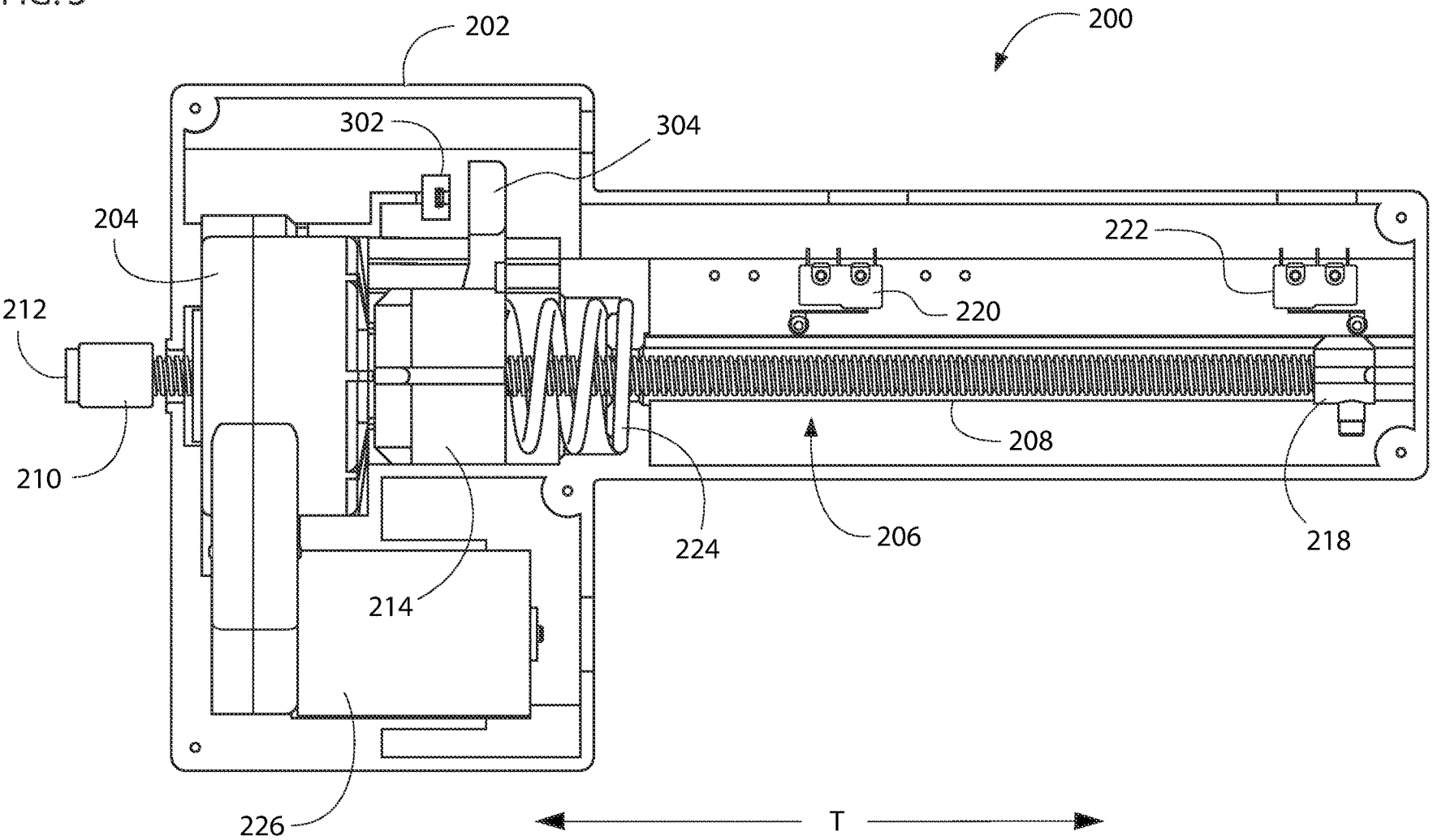
FIG. 5 provides a top-down section view of the exemplary door opener of FIG. 4.
Figure 6:
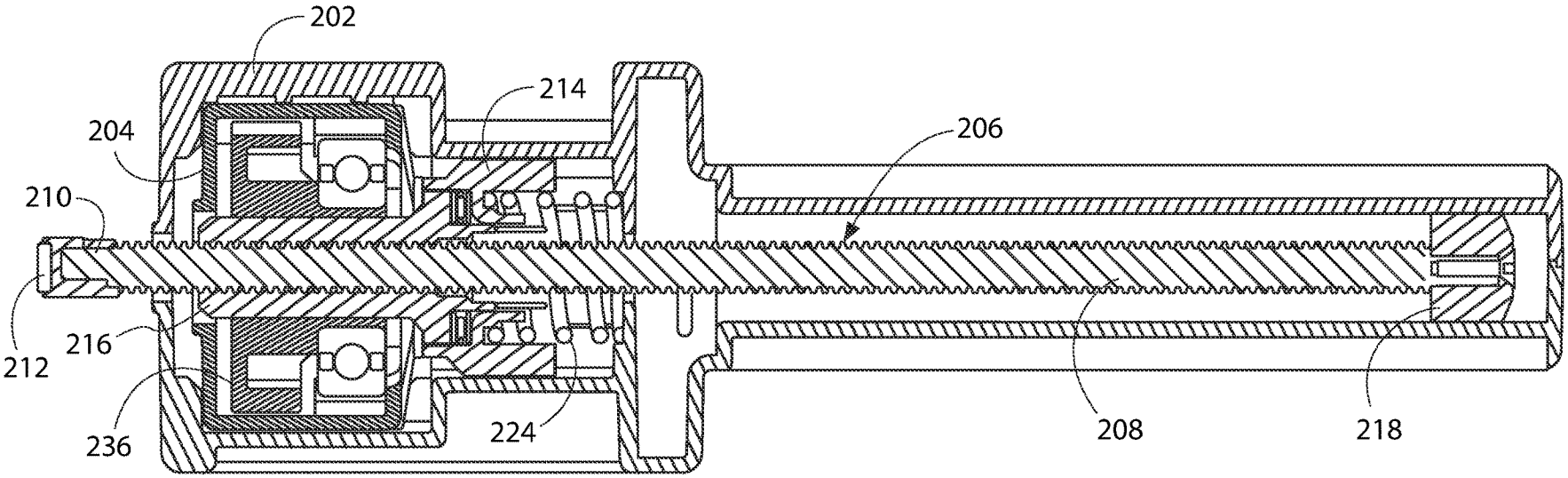
FIG. 6 provides a cross-section of the exemplary door opener of FIG. 4.

In some embodiments, e.g., as best seen in FIGS. 4 and 5, a front limit switch 220 may be provided proximate the front portion 201 of the casing 202 and in operative communication with the motor 226. In such embodiments, the front limit switch 200 may be configured to deactivate the motor 226 when the front limit switch 220 is toggled. For example, the front limit switch 220 may be toggled when, as illustrated in FIGS. 4-6, a translating carriage 218 at the back end of the finger 206 contacts the front limit switch 220. Thus, the extended position may be a fully extended position (as distinct from an intermediate or partially extended position) in that the maximum forward distance along the transverse direction T that the finger 206 can travel is defined by the point at which the front limit switch 220 is contacted by the translating carriage 218.

In some embodiments, the distance that the finger 206 travels when the door opener 200 is activated may be controlled by a timer as well as or instead of the front limit switch 220. For example, the distance that the finger 206 travels when the door opener 200 is activated may be variable and may be set to less than the fully extended position, e.g., based on a user input selection, where the motor 226 is turned off when the timer expires, and the timer may expire before the finger 206 travels to the fully extended position.

In various embodiments, the door opener 200 may include a plurality of gears within the gear box 204. For example, in the illustrated embodiments, the door opener 200 includes three gears. In additional embodiments, the door opener 200 may include only two gears or more than three gears. Also, in some embodiments, the gear ratios, e.g., the relative sizes of the gears may vary from those illustrated. As may be seen, e.g., in FIGS. 8, 9 and 10, in some embodiments, the motor 226 may be directly coupled to a first gear 232 and the first gear 232 may be in contact with and mutually engaged with a second gear 234. The second gear 234 may, in turn, also be in contact with and mutually engaged with a drive gear 236 opposite the first gear 232. The gears 232, 234, and 236 may have external teeth thereon, as illustrated, which engage with external teeth of each adjoining gear. As mentioned, additional embodiments may include the first gear 232 in direct contact with the drive gear 236 or additional intermediate gears between the first gear 232 and the drive gear 236 in addition to the second gear 234, among other possible variations within the scope of the present disclosure.

The sliding nut 216 may be movable relative to the drive gear 236, e.g., through the drive gear 236, along the transverse direction T, e.g., linearly or in translation. At the same time, the sliding nut 216 may be fixed with or engaged with the drive gear 236 in rotation, e.g., about or around the transverse direction T. For example, the sliding nut 216 may include one or more linear flanges 244, e.g., four linear flanges 244 as illustrated, whereby the sliding nut 216 is generally cruciform. The linear flanges 244 may extend generally along the transverse direction T on an exterior surface of the sliding nut 216. The sliding nut 216, including the linear flanges 244 thereof, may extend through a correspondingly shaped aperture 246 in the drive gear 236. The sliding nut 216 may fit through the aperture 246 in the drive gear 236 with sufficient clearance for the sliding nut 216 to translate relative to the drive gear 236 along the transverse direction T. When the drive gear 236 rotates about the transverse direction T, e.g., when the motor 226 is activated to rotate the gears 232, 234, and 236, the sides of the aperture 246 in the drive gear 236 bear on the linear flanges 244 of the sliding nut 216 such that the sliding nut 216 rotates with the drive gear 236.

Figure 7:
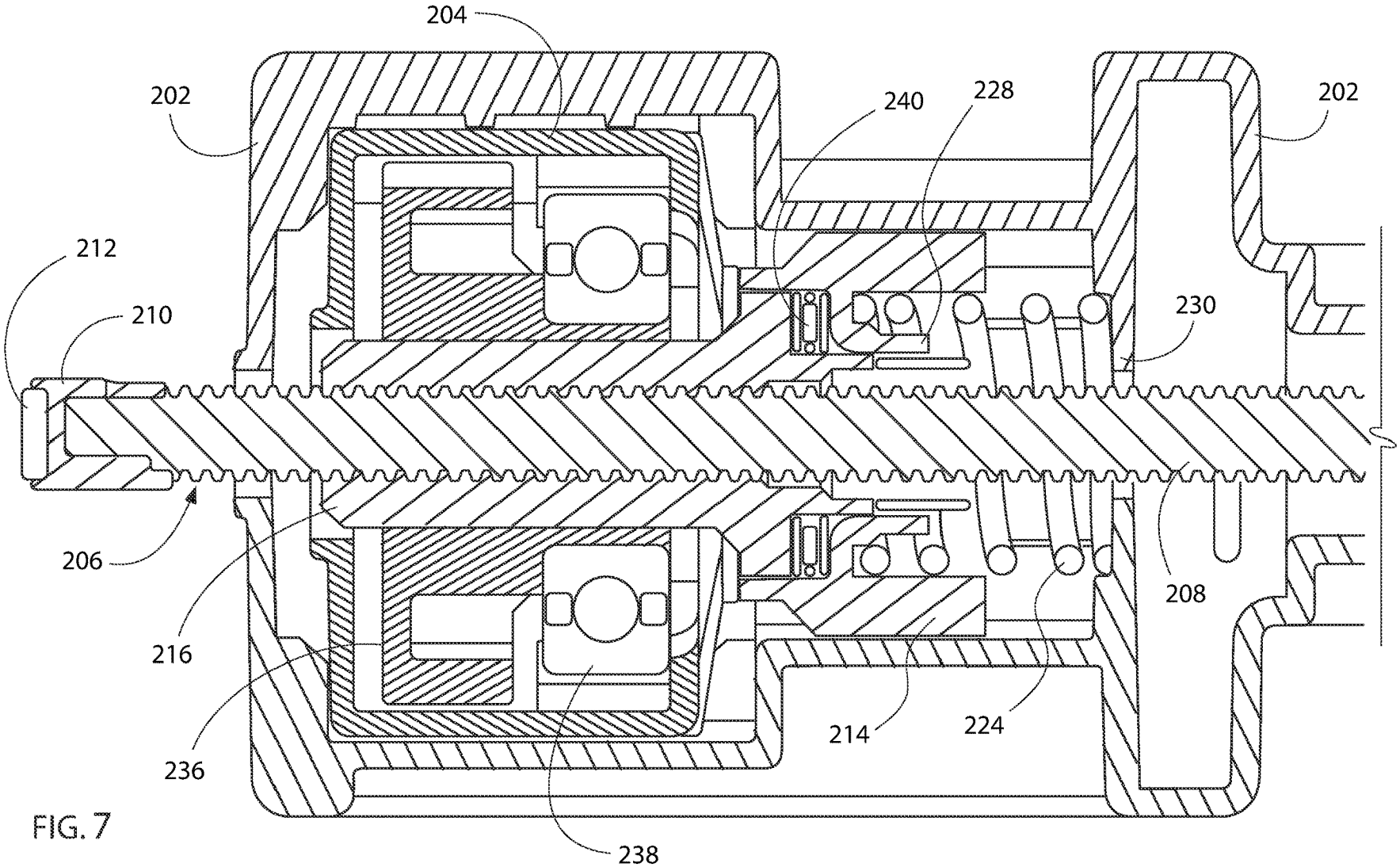
FIG. 7 provides an enlarged cross-section of a portion of the exemplary door opener of FIG. 4.
Figure 8:
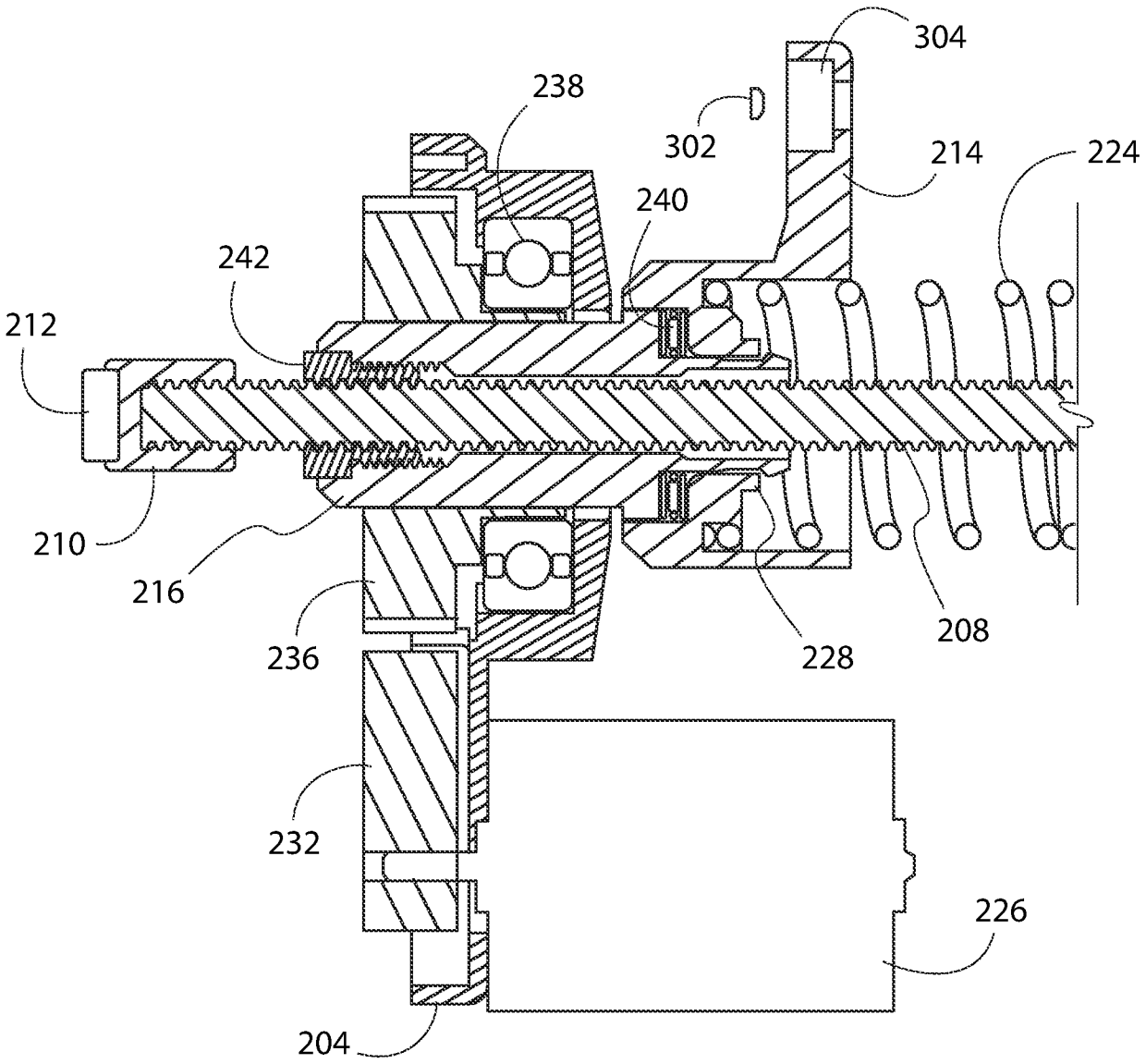
FIG. 8 provides another enlarged cross-section of a portion of the exemplary door opener of FIG. 4.
Figure 9:
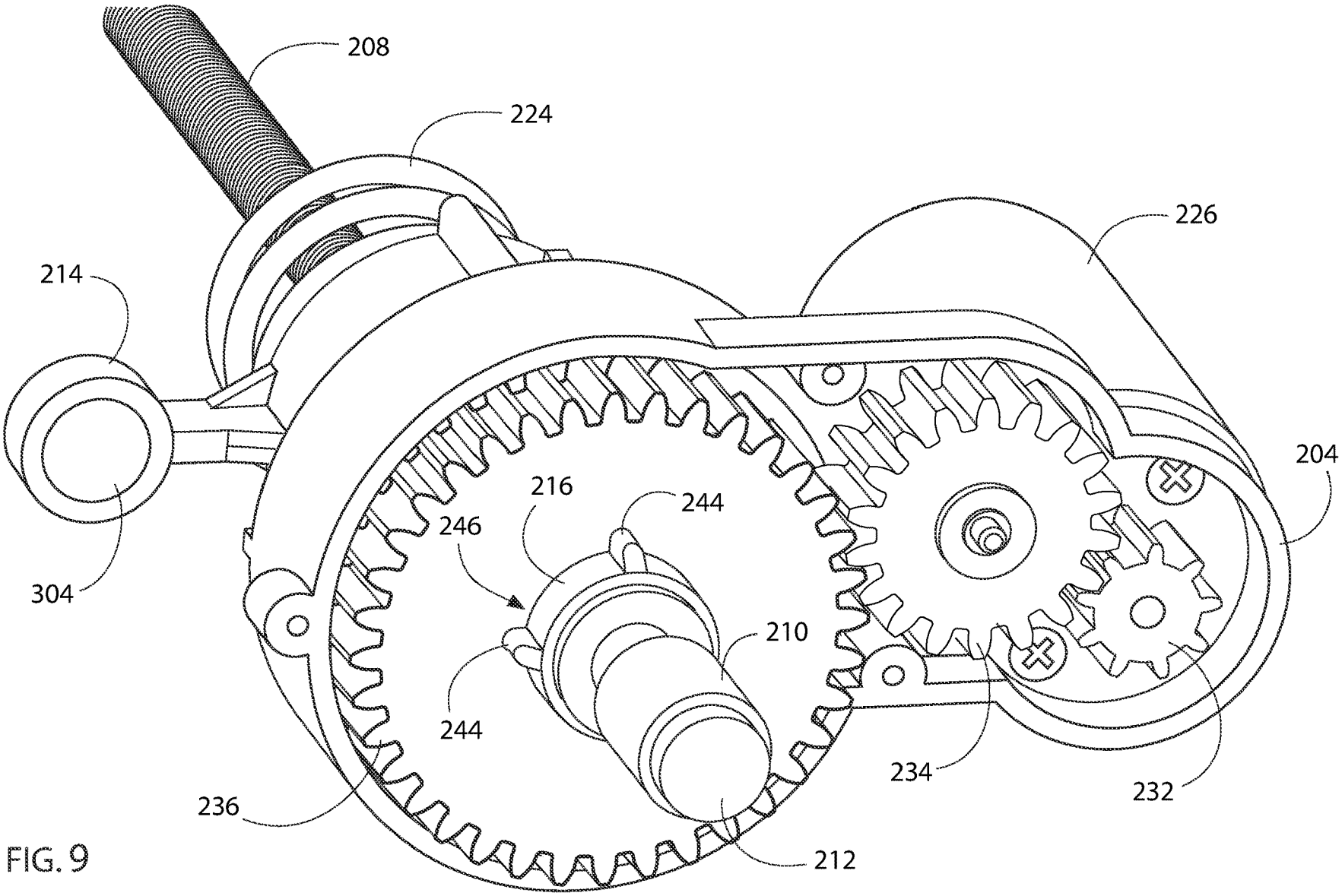
FIG. 9 provides a perspective view of a portion of the exemplary door opener of FIG. 4.
Figure 10:
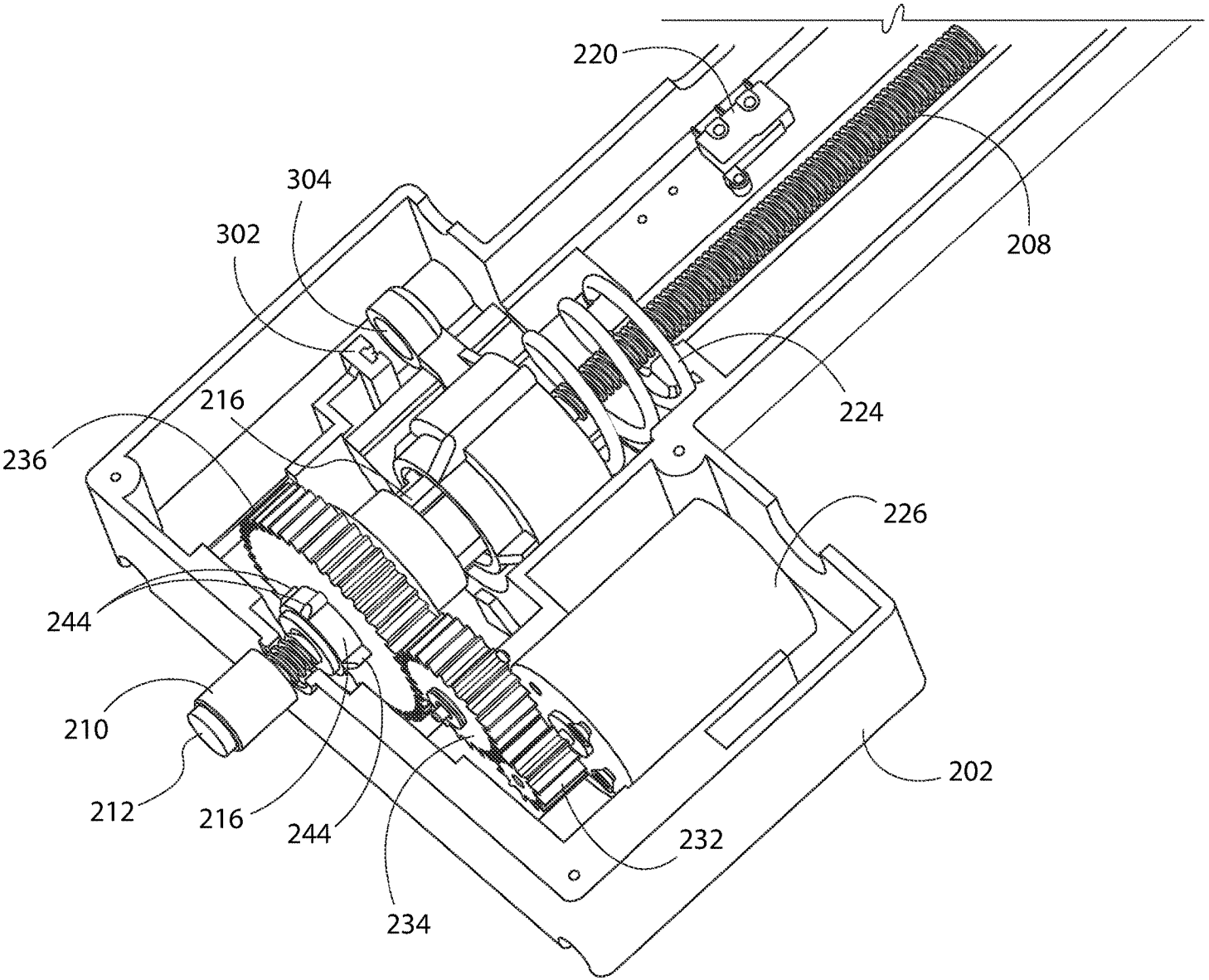
FIG. 10 provides a perspective view of another portion of the exemplary door opener of FIG. 4.

When the sliding nut 216 rotates with the drive gear 236, the sliding nut 216 may also rotate relative to the housing 214. Thus, in some embodiments, the door opener 200 may also include features for accommodating such relative rotation. For example, as illustrated in FIGS. 7 and 8, the door opener 200 may include bearings, such as roller bearings 240, between the sliding nut 216 and the housing 214. In other embodiments, the door opener 200 may also or instead include a lubricant between the sliding nut 216 and the housing 214 or the opposing surfaces of the sliding nut 216 and the housing 214 may be comprised of or coated with a low-friction material or a lubricious material. Also as may be seen, e.g., in FIG. 7, the door opener 200 may further include ball bearings 238 between the drive gear 236 and the gear box 204, where the ball bearing 238 may serve both as a spacer for positioning the drive gear 236 within the gear box 204 and promote rotation of the drive gear 236 within and relative to the gear box 204.

The sliding nut 216 may be threaded, e.g., may include internal threads thereon, and may engage external threads on the power screw portion 208 of the finger 206. The sliding nut 216 may be directly threadedly engaged with the power screw portion 208 of the finger 206 or may be indirectly threadedly engaged with the power screw portion 208 of the finger 206. The internal threads may be integrally formed in the sliding nut 216, e.g., as illustrated in FIG. 7, for direct threaded engagement, or may be provided on a second piece, such as a screw thimble 242, as illustrated in FIG. 8, for indirect threaded engagement of the sliding nut 216 and the power screw portion 208 of the finger 206. In embodiments where the screw thimble 242 is provided, the screw thimble 242 may be formed of a different material than the sliding nut 216. For example, the sliding nut 216 may include and/or consist of a polymeric material, e.g., plastic, and the screw thimble 242 may include and/or consist of a more robust material, such as a metal material.

Thus, the motor 226 may be operable to rotate the drive gear 236 in a first direction when activated, while the drive gear 236 in turn rotates the sliding nut 216 which is threadedly engaged with the power screw portion 208 of the finger 206 to move the finger 206 from the zero position to the extended position. The motor 226 may further be operable in a reverse direction, e.g., to rotate the drive gear 236 in a second direction opposite the first direction, such that the drive gear 236 and the sliding nut 216 operate to retract the finger 206, e.g., to move the finger 206 from the extended position to the zero position. As will be understood from the foregoing, the finger 206, e.g., the power screw portion 208 thereof, may thus be rotatable about the transverse direction T while also translatable along the transverse direction T to move between the zero position and the extended position when the motor 226 is activated.

In some embodiments, the door opener 200 may also include a back limit switch 222. Similar to the front limit switch 220 described above, the back limit switch 222 may deactivate or reverse the motor 226 when toggled, e.g., contacted by the translating carriage 218.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber extending between a front portion and a back portion along the transverse direction, the front portion of the food storage chamber defining an opening for receipt of food items;

a door positioned at the front portion of the food storage chamber and movable between a closed position and an open position to selectively sealingly enclose the food storage chamber in the closed position and provide access to the food storage chamber in the open position;

a door opener positioned in the cabinet, the door opener comprising a casing, a housing, a biasing element extending between the housing and the casing, the biasing element configured to bias the housing and the finger towards the front portion of the cabinet, a gear box, a sliding nut movable relative to the gear box, a finger extending through the gear box towards the door, the finger movable with the sliding nut, and a sensor, the finger positioned in contact with an inner surface of the door when the door is in the closed position and the door opener is in a zero position, wherein the sensor is configured to detect movement of the door opener from the zero position of the door opener.

2. The refrigerator appliance of claim 1, further comprising a housing and a magnet mounted in the housing, wherein the sensor is a Hall effect sensor and the Hall effect sensor responds to the magnet.

3. The refrigerator appliance of claim 1, wherein the door opener further comprises a motor in operative communication with the sensor and the finger, the sensor configured to transmit a signal to the motor when the sensor detects movement of the door opener from the zero position of the door opener, the motor configured to receive the signal from the sensor, to activate in response to the signal from the sensor, and to move the finger towards the front portion of the cabinet along the transverse direction when the motor is activated.

4. The refrigerator appliance of claim 3, wherein the motor is configured to rotate a drive gear within the gear box when the motor is activated.

5. The refrigerator appliance of claim 4, wherein the finger comprises a front portion extending through the gear box and the casing and a threaded back portion, wherein the drive gear engages the sliding nut when the drive gear is rotated, the sliding nut comprising internal threads engaged with the threaded back portion of the finger, whereby rotation of the sliding nut by the drive gear moves the finger towards the front portion of the cabinet along the transverse direction.

6. The refrigerator appliance of claim 5, wherein the door opener further comprises a housing, wherein the housing translates along the transverse direction when the door opener moves inward away from the zero position.

7. The refrigerator appliance of claim 3, wherein the door opener further comprises a front limit switch in operative communication with the motor, wherein the front limit switch is configured to deactivate the motor when the front limit switch is toggled.

8. The refrigerator appliance of claim 1, wherein the biasing element is a coil spring.

9. A door opener for a refrigerator appliance, the door opener defining a vertical direction, a lateral direction, and a transverse direction, the vertical, lateral, and transverse directions being mutually perpendicular, the refrigerator appliance comprising a cabinet defining a food storage chamber and a door mounted on the cabinet, the door movable between a closed position and an open position to selectively sealingly enclose the food storage chamber in the closed position and provide access to the food storage chamber in the open position, the door opener comprising:

a casing;

a housing;

a biasing element extending between the housing and the casing, the biasing element configured to bias the housing and the finger towards the front portion of the cabinet;

a gear box;

a sliding nut movable relative to the gear box;

a finger extending through the gear box, the finger movable with the sliding nut; and a sensor;

wherein the finger extends outside of the casing to contact an inner surface of the door when the door is in the closed position and the door opener is in a zero position, wherein the sensor is configured to detect movement of the door opener from the zero position.

10. The door opener of claim 9, further comprising a housing and a magnet mounted in the housing, wherein the sensor is a Hall effect sensor and the Hall effect sensor responds to the magnet.

11. The door opener of claim 9, further comprising a motor in operative communication with the sensor and the finger, the sensor configured to transmit a signal to the motor when the sensor detects movement of the door opener from the zero position of the door opener, the motor configured to receive the signal from the sensor, to activate in response to the signal from the sensor, and to move a tip of the finger away from the casing along the transverse direction when the motor is activated.

12. The door opener of claim 11, wherein the motor is configured to rotate a drive gear within the gear box when the motor is activated.

13. The door opener of claim 12, wherein the finger comprises a front portion extending through the gear box and the casing and a threaded back portion, wherein the drive gear engages the sliding nut when the drive gear is rotated, the sliding nut comprising internal threads engaged with the threaded back portion of the finger, whereby rotation of the sliding nut by the drive gear moves the finger towards the front portion of the cabinet along the transverse direction.

14. The door opener of claim 13, further comprising a housing, wherein the housing translates along the transverse direction when the door opener moves inward away from the zero position.

15. The door opener of claim 11, further comprising a front limit switch in operative communication with the motor, wherein the front limit switch is configured to deactivate the motor when the front limit switch is toggled.

16. The door opener of claim 9, wherein the biasing element is a coil spring.

* * * * *